United States Patent [19]

Johnson et al.

[11] 4,026,814

[45] May 31, 1977

[54] OXIDO-REDUCTASE IN SOAP

[75] Inventors: George Arthur Johnson, Wirral; Martin Rodney Ewart, Chester; Brian Anthony Pethica, Altrincham, all of United Kingdom

[73] Assignee: Lever Brothers Company, New York, N.Y.

[22] Filed: Aug. 25, 1975

[21] Appl. No.: 607,166

[30] Foreign Application Priority Data

Sept. 9, 1974 United Kingdom ..... 39031/74

[52] U.S. Cl. ..... 252/132; 252/108; 252/117; 252/DIG. 12

[51] Int. Cl.[2] ..... C11D 9/22; C11D 9/40

[58] Field of Search ..... 252/107, 108, 117, 132, 252/DIG. 12; 195/3; 260/398.5, 418, 419, 420

[56] References Cited

UNITED STATES PATENTS

| | | | |
|---|---|---|---|
| 2,320,478 | 6/1943 | Sperti | 252/132 |
| 2,416,052 | 2/1947 | Gribbins | 260/398.5 |
| 2,660,589 | 11/1953 | Squire et al. | 260/419 |
| 2,921,907 | 1/1960 | Kleyn | 252/107 |
| 2,971,917 | 2/1961 | Fasco et al. | 252/107 |
| 3,451,935 | 6/1969 | Roald et al. | 252/135 |
| 3,522,145 | 7/1970 | Apostolatos et al. | 195/3 |
| 3,640,877 | 2/1972 | Gobert | 252/99 |
| 3,689,419 | 9/1972 | Yueh | 252/90 |
| 3,781,228 | 12/1973 | McDonnell et al. | 252/539 |

FOREIGN PATENTS OR APPLICATIONS

| | | |
|---|---|---|
| 513,696 | 10/1939 | United Kingdom |

*Primary Examiner*—P.E. Willis, Jr.
*Attorney, Agent, or Firm*—Kenneth F. Dusyn; James J. Farrell; Melvin H. Kurtz

[57] ABSTRACT

A soap with a reduced tendency to generate malodours during storage is provided by incorporating an enzyme system which contains an oxido-reductase enzyme and a hydrogen acceptor.

10 Claims, No Drawings

OXIDO-REDUCTASE IN SOAP

BACKGROUND OF THE INVENTION

It is well known that soaps produced from low-grade fatty materials, such as low-grade tallow often develop an unpleasant odour during storage. It is therefore common in the soap-manufacturing industry either to pre-treat the low-grade fatty material to remove malodorous components therefrom, to use more expensive higher-grade fatty materials or to add perfumes so as to mask the unpleasant malodours. The methods applied to avoid or mitigate the emanation of malodours increase the production costs of toilet soaps.

SUMMARY OF THE INVENTION

Soap, particularly toilet soap bars with a reduced tendency to generate malodours are produced by incorporating an effective amount of an enzyme system which contains an oxido-reductase enzyme and an appropriate hydrogen acceptor, particularly a coupled dehydrogenase system containing an alcohol dehydrogenase and an aldehyde dehydrogenase The present invention relates to a toilet soap bar, said bar containing a small, effective amount of oxido-reductase enzymes.

Oxido-reductases are classified in the enzyme commission (E.C.) class 1, subclasses 1.1 and 1.2. They comprise enzymes acting on the —CHOH group of donors, using particular acceptors. Specific examples of enzymes belonging to this subclass (E.C. 1.1.) are alcohol: NAD and alcohol: NADP oxido-reductases, which are alcohol dehydrogenases (ADH) using nicotinamide-adenine-dinucleotide (NAD) or nicotinamide-adenine-dinucleotide phosphate (NADP) as acceptor. The relevant E.C. classifications are E.C. 1.1.1.1. and 1.1.1.2. Subclass 1.2. comprises enzymes acting on the aldehyde or keto groups of donors. Specific examples are aldehyde: NAD an aldehyde NADP oxido-reductases (E.C. 1.2.1.3 and 1.2.1.4), using NAD or NADP as acceptor and xanthine: oxygen oxido-reductase (E.C. 1.2.3.2).

Although in principle all oxido-reductases belonging to the E.C. subclasses 1.1 and 1.2 would be suitable for incorporation in the toilet soap bars of the invention, preferably those enzymes are used which oxides or reduce fatty aldehydes of chain length $C_2$ to $C_{12}$, particularly $C_3$ to $C_6$. Alcohol dehydrogenase using reduced NAD, i.e. NADH as co-enzyme, is preferred, as this enzyme system produces the best results.

Therefore the present invention in particular relates to a toilet soap bar, said bar containing a small, effective amount of an enzyme system containing alcohol dehydrozenase, and NADH as co-enzyme. It has furthermore been found that a coupled dehydrogenase system even further improved the storage stability of the toilet soap bars. This coupled dehydrogenase system contains an alcohol dehydrogenase and an aldehyde dehydrogenase (E.C. 1.1.1.1 and E.C. 1.2.1.5).

This system is e.g. contained in a crude baker's yeast extract.

The present invention therefore also relates to a toilet soap bar, said bar containing a small, effective amount of a mixture of alcohol dehydrogenase and aldehyde dehydrogenase, and NADH as co-enzyme.

The amount of the oxido-reductase enzyme to be used in the toilet soap bar of the present invention is generally from 0.01 to 0.25%, and preferably from 0.07 to 0.15%.

The amount of the co-enzyme is generally from 0.015 to 0.5%, and depends on the particular system considered.

The toilet soap bar is prepared in any suitable manner as is well-known in the art. The fatty material from which the bar is made may be any suitable animal and/or vegetable far or oil, such as tallow, coconut oil and so on. The present invention even allows the use of a low-to-medium-grade tallow.

The oxido-reductases are added to the soap base at the milling stage, i.e. to the soap chips. They are normally added in the form of an aqueous buffer solution, as are the co-enzymes.

The invention will now be further illustrated by way of Examples.

EXAMPLE I

The following toilet soap bars were prepared from crude tallow chips in the usual way. The oxido-reductase containing bars were made from chips which had been treated with alcohol dehydrogenase (ADH) and co-enzyme (NADH), or with a crude enzyme extract from yeast. The treated chips were milled three times and then pressed into bars.

The buffer solution used for the ADH was an aqueous solution of sodium phosphate, 0.01 M (pH 7.4), and the buffer solution for the NADH was an aqueous solution of 0.01 M sodium pyrophosphate (pH 8.8).

The crude enzyme extract from yeast was prepared in the following way.

Two pounds of baker's yeast were finely divided into small crumbs, these were then plunged into liquid nitrogen. The nitrogen was allowed to evaporate once all the yeast had been immersed. The frozen yeast was then left to thaw at 4° C. This treatment resulted in lysis of yeast cells. To the thawed yeast cells were added 500 ml 0.3M $K_2HPO_4$ and the mixture stirred for 3 hrs at 4° C to extract the dehydrogenase enzymes. The suspension was centrifuged at 10,000 rpm (16,000 g) for 10 min., and the resulting supernatant was designated "first crude enzyme extract". The pellets were resuspended in 200 ml 0.3M $K_2HPO_4$ and left at 4° C for 24 hrs with slow continuous stirring. The mixture was centrifuged as above; the supernatant obtained was designated "second crude enzyme extract". The crude extracts contained co-enzymes, substrates and at least two hydrogenase enzymes. The supernatants were filtered through sterile millipore membranes to exclude viable yeast cells.

The enzyme activity was measured by finding the time required for o.1 ml of extract to reduce 1 ml of 0.0025 M oxidised nicotinamide-adenine-dinucleotide ($NAD^+$). The protein concentration was determined for the two extracts by Lowry's method (J. Biol. Chem. 193, 265 (1951) ). The specific activity was defined as the increase in absorbance per minute per 0.1 ml extract per milligram of protein.

The odour of the bars, which were stored at 23° C/70% RH and 37° C (no humidity control), was rated by at least ten assessors after various storage times. The assessors were asked to select the bar with the stronger odour in a given pair. There were either six or three different treatments within a batch, which involved assessing fifteen or three different combinations respectively. The ranking of bars in a batch was calculated by a computer program (STCT AAAl) which also gave the standard error. This was used to determine if there were significant differences between the bars, within 95% probability limits.

| Crude Tallow Soap Bar Formulations | |
|---|---|
| A. Tallow Soap | 380 g |
| Water | 20 g |
| B. Tallow Soap | 380 g |
| Alcohol Dehydrogenase 4 mg/ml buffer | 10 ml |
| NADH 7.1 mg/ml buffer | 10 ml |
| C. Tallow Soap | 380 g |
| Alcohol Dehydrogenase 40 mg/ml buffer | 10 ml |
| NADH 71 mg/ml buffer | 10 ml |
| D. Tallow Soap | 570 g |
| 0.01 M Sodium Pyrophosphate buffer | 30 ml |
| E. Tallow Soap | 570 g |
| Alcohol Dehydrogenase 40 mg/ml buffer | 15 ml |
| NADH 2.37 g/15 ml buffer | 15 ml |
| F. Tallow Soap | 570 g |
| Alcohol Dehydrogenase 4 mg/ml buffer | 15 ml |
| NADH 0.237 g/15 ml buffer | 15 ml |
| G. Tallow Soap | 570 g |
| 0.3M $K_2HPO_4$ buffer | 30 ml |
| H. Tallow Soap | 570 g |
| Yeast Extract (Specific Activity 0.0299) | 30 ml |
| I. Tallow Soap | 570 g |
| Yeast Extract (Specific Activity 0.0299) | 30 ml |
| NADH (dissolved in yeast extract) | 0.5 g |
| J. Tallow Soap | 570 g |
| $K_2HPO_4$ buffer | 30 ml |
| K. Tallow Soap | 570 g |
| Yeast Extract (Specific Activity 0.0349) | 30 ml |
| L. Tallow Soap | 570 g |
| Yeast Extract (Specific Activity 0.0349) | 30 ml |
| NADH (dissolved in yeast extract) | 0.5 g |
| M. Untreated Tallow Soap | 140 g |
| N. Tallow Soap | 950 g |
| Aqueous Hexanal 0.2% (in 0.01M sodium pyrophosphate buffer solution, pH 8.8) | 50 ml |
| O. Tallow Soap as in formulation N. | 200 g |
| Alcohol Dehydrogenase 0.1 g/ml buffer | 2 ml |
| NADH 0.354 g/ml buffer | 2 ml |

The following results were obtained:

1. Comparison of tallow soap (M), tallow soap + hexanal (0.01%) (N) and tallow soap + hexanal + alcohol dehydrogenase + NADH (O) bar odour.

| Age of Bars | Strongest | | Ranking of Bar Odour | | Weakest |
|---|---|---|---|---|---|
| (days) | 1 | | 2 | | 3 |
| 7 | M | = | 0 | = | N |
| 14 | N | > | M | > | 0 |
| 32 | M | = | N | > | 0 |
| 114 | N | > | M | = | 0 |

= denotes not significantly different within 95% probability limits.
> denotes significantly greater within 95% probability limits.

These symbols are used in all the following tables.

2) Odour Assessment of Untreated Tallow Soap (D) with Enzyme-Treated Tallow Soap at Two Concentrations, 0.1% and 0.01% (E and F respectively)

| Age of Bars | Strongest | | Ranking of Bar Odour | | Weakest |
|---|---|---|---|---|---|
| (days) | 1 | | 2 | | 3 |
| 3 | E | = | F | > | D |
| 17 | D | = | F | > | E |

3) Odour Assessment of Yeast Enzyme Extract Treated Tallow Soap without added NADH (H) with added NADH (I) compared with Untreated Tallow Soap (G)

-continued

| Age of Bars | Strongest | | Ranking of Bar Odour | | Weakest |
|---|---|---|---|---|---|
| (days) | 1 | | 2 | | 3 |
| 1 | G | > | I | > | H |
| 12 | I | = | G | > | H |
| 48 | G | > | H | = | I |

4) Odour Assessment of Tallow Soap (J) with Yeast Enzyme Extract Treated Tallow Soap (K) and Yeast Enzyme Extract Treated Tallow Soap + NADH (L)

| Age of Bars | Strongest | | Ranking of Bar Odour | | Weakest |
|---|---|---|---|---|---|
| (days) | 1 | | 2 | | 3 |
| 1 | J | > | K | > | L |
| 15 | J | > | L | = | K |
| 36 | J | > | L | = | K |
| 43 | J | > | K | = | L |

These results show the following:

ad 1. This series of tests comparing the odour of hexanal supplemented tallow soap bars with control bars during storage at 23° C over a total of 114 days showed that the enzyme-treated bar was consistently rated as of significantly weaker odour after the initial test. Further, hexanal supplemented tallow soap which had been treated with enzyme was consistently rated as of weaker odour than a tallow soap to which neither hexanal nor enzyme had been added, although these differences were not always statistically significant.

ad 2. Comparison of tallow bars (without added hexanal) after 17 days storage showed that the bar without enzyme was rated by the panel as having significantly stronger odour than the bar containing 0.1% alcohol dehydrogenase + NADH.

ad 3. When tallow bars treated with crude yeast extract, with and without additional NADH, were compared with control bars, the treated bars were found to be of consistently lower odour than the controls over a storage period of 48 days. Statistically significant differences were obtained throughout when soap + yeast extract (without added NADH) was compared with control.

ad 4. In this series of comparisons covering a total storage time of 43 days both yeast enzyme treated bars were consistently rated as having significantly less odour than the untreated ones. Addition of NADH to the yeast extract was found to confer no extra benefit.

What is claimed is:

1. A soap of a fatty acid comprising a. an oxido-reductases enzyme in an amount effective to inhibit the generation of malodors during storage of the soap;

b. a hydrogen acceptor selected from the group consisting of nicotinamide-adenine-dinucleotide, nicotinamide-adenine-dinucleotide phosphate and mixtures thereof.

2. A soap according to claim 1 wherein the oxido-reductase enzyme is selected from the group consisting of alcohol dehydrogenase, aldehyde dehydrogenase and mixtures thereof.

3. A soap according to claim 1 comprising from about 0.01–0.25% by weight of the oxido-reductase enzyme and about 0.015–0.5% by weight of the hydrogen acceptor.

4. A soap according to claim 3 comprising from about 0.07–0.15% by weight of the oxido-reductase enzyme.

5. A soap according to claim 1 wherein the oxido-reductase enzyme is prepared by extraction from crude baker's yeast.

6. A soap according to claim 1 in the form of a soap bar.

7. A method for the manufacture of a soap of a fatty acid which comprises incorporating in the soap an oxido-reductase enzyme and a hydrogen acceptor selected from the group consisting of nicotinamide-adenine-dinucleotide, nicotinamide-adenine-dinucleotide phosphate and mixtures thereof, in an amount effective to inhibit the generation of malodors during storage.

8. The method according to claim 7 wherein the oxido-reductase enzyme is selected from the group consisting of alcohol dehydrogenase, aldehyde dehydrogenase and mixtures thereof.

9. The method according to claim 7 wherein the amount of oxido-reductase enzyme incorporated into the soap is 0.01–0.25% by weight, and the amount of hydrogen acceptor incorporated into the soap is 0.015–0.5% by weight.

10. The method according to claim 7 wherein the oxido-reductase enzyme is extracted from crude baker's yeast.

* * * * *